United States Patent [19]

Steckenrider

[11] 4,077,342

[45] Mar. 7, 1978

[54] THREAD TRIMMING MECHANISM FOR SEWING MACHINES

[75] Inventor: Paul E. Steckenrider, Hoffman Estates, Ill.

[73] Assignee: Union Special Corporation, Chicago, Ill.

[21] Appl. No.: 729,925

[22] Filed: Oct. 6, 1976

Related U.S. Application Data

[63] Continuation-in-part of Ser. No. 640,982, Dec. 15, 1975, abandoned.

[51] Int. Cl.[2] ..... D05B 65/02

[52] U.S. Cl. ..... 112/292; 112/294; 112/297

[58] Field of Search ..... 112/252, 130, 242, 181, 112/189

[56] References Cited

U.S. PATENT DOCUMENTS

| | | | |
|---|---|---|---|
| 1,403,518 | 1/1922 | Molyneux | 112/252 |
| 1,422,407 | 7/1922 | Becker | 42/252 |
| 1,438,548 | 12/1922 | Ostrom et al. | 112/252 |
| 2,474,710 | 6/1949 | Wood | 112/252 |
| 3,386,402 | 6/1968 | Ross | 112/252 |
| 3,709,176 | 1/1973 | Papajewski et al. | 112/252 |
| 3,776,161 | 12/1973 | Papajewski et al. | 112/252 |

*Primary Examiner*—H. Hampton Hunter
*Attorney, Agent, or Firm*—John W. Harbst; John A. Schaerli

[57] ABSTRACT

A sewing machine thread trimming mechanism for severing both the needle thread and bobbin thread close to the workpiece at the end of a stitching operation and for providing a sufficient length of bobbin thread after trimming so that stitching on a succeeding seam may proceed. The thread trimming mechanism includes a trimming device having two pivotly connected moveable blades which are swingably mounted beneath the sewing machine throat plate. One of the blades is mounted for movement into the needle thread and bobbin thread path whereby engaging and carrying the same into severing engagement with the second moveable blade. The second moveable blade is eccentrically pivoted relative the first blade and is provided with a floating fulcrum which controls the movement of the second blade so as to produce a true scissor like action between the two blades. The thread trimming mechanism further includes a bobbin thread pull-off which engages and withdraws a sufficient length of bobbin thread prior to severance of the thread by the trimming mechanism.

20 Claims, 12 Drawing Figures

FIG. 1
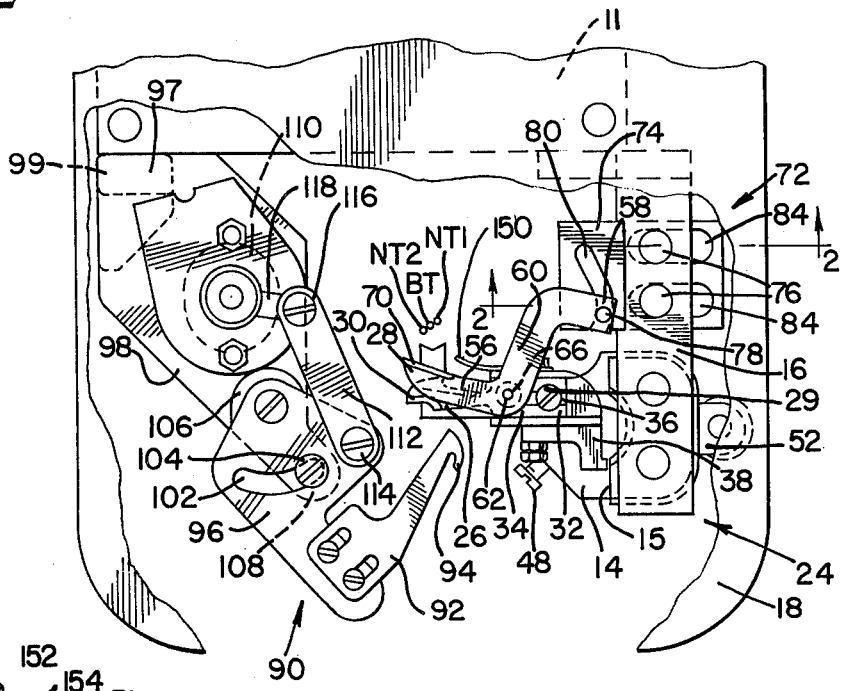
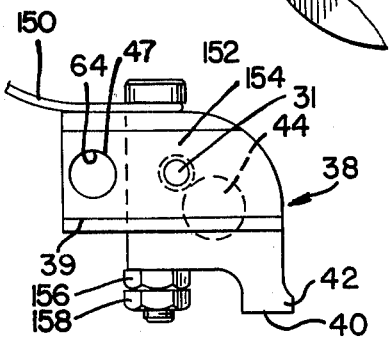
FIG. 3
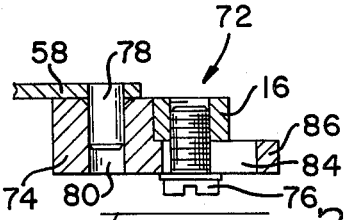
FIG. 2
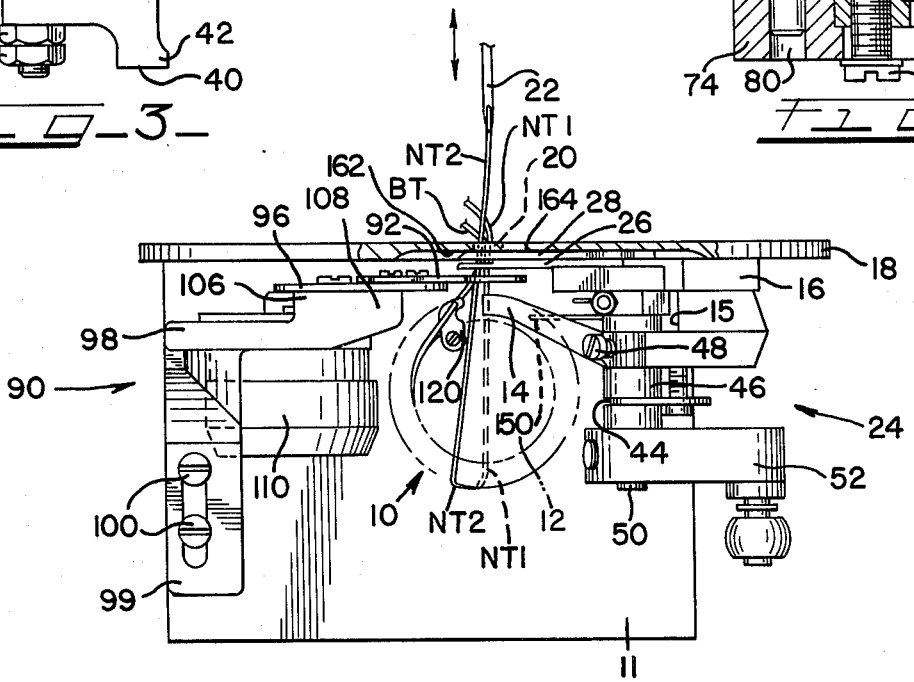
FIG. 4

THREAD TRIMMING MECHANISM FOR SEWING MACHINES

This invention is a continuation-in-part of my application, Ser. No. 640,982 filed Dec. 15, 1975, now abandoned.

The present invention relates to sewing machines and more particularly to sewing machine thread trimming mechanisms which utilize two moveable blades that cooperate in unison for cutting both the needle thread and bobbin thread in a close relationship with the underside of the workpiece that is sewn. The present invention also provides for a sufficient length of bobbin thread to be present after the trimming cycle to assure that stitching on a succeeding seam may proceed.

BACKGROUND OF THE INVENTION

This invention represents an improvement over such apparatus as disclosed in U.S. Pat. No. 3,424,116 issued Jan. 28, 1969 to W. R. von Hagen.

Thread trimming mechanisms fixedly secured beneath the sewing machine throat plate are most highly developed in the prior art as may be represented in the above mentioned patent. However, many of the thread cutters heretofore known, as well as the device found in U.S. Pat. No. 3,424,116 utilize a single moveable blade and a stationary blade associated therewith for severing the thread. In devices of this sort the moveable blade swings into the path of the needle thread and bobbin thread whereby seizing and drawing the threads over to the stationary cutter blade where the threads are cut. In devices of this sort there are certain drawbacks. One of the drawbacks incurred in using this type of device is the excessive length of the thread tail that is left depending from the garment. That is, when the moveable blade draws the threads over to the stationary blade the tail length depending from the garment will be increased due to this drawing action. Because of the excessive depending tail length a separate manual operation which entails cutting off the extra length is necessitated, thereby yielding an acceptable garment. However, this added manual operation adds time and thus cost to the garment manufacturer. Another drawback in utilizing a moveable blade with a stationary blade is that the synthetic threads employed today are more difficult to cut than the conventional cotton thread. In some instances, the cutting of synthetic threads is enhanced by means of a thread clamp which clamps the thread in place while the blade is operative thereon.

Although it is most desirable to provide a short tail length on the garment produced there is a definite need for a sufficient amount of bobbin thread to be present prior to the start of the next stitching cycle whereby assuring that the first few stitches in the following sewing cycle may be formed correctly.

SUMMARY OF THE INVENTION

In view of the foregoing, and in accordance with the present invention there has been developed a sewing machine thread trimming mechanism which obviates the disadvantages mentioned above by providing a thread trimming mechanism that includes first and second moveable blade means positioned closely adjacent the sewing machine throat plate, and which cooperate in timed relation with a bobbin thread pull-off whereby providing both an accepable short tail length on the garment produced and a sufficient length of bobbin thread after severence so as to insure the correct formation of stitches on the following seam. By the provision of two moveable blades a more positive cutting action is made possible.

The invention here under consideration includes first and second moveable blades each having first and second end portions and a medial portion therebetween. Both blades are pivotally connected at their intermediary portion and are adjustable relative one another. The two moveable blades are swingably positioned below the sewing machine throat plate. One of these blades is rotatably mounted for movement into the needle thread and bobbin thread path whereby engaging and carrying the same into severing engagement with the second moveable blade. The second moveable blade is carried on top of the first moveable blade and is eccentrically pivotly connected thereto. The second moveable blade is provided with a first end portion which defines a first cutting blade portion and a second end portion which associates with a motion imparting means for controlling the movement and speed of the second blade whereby producing a scissor like action between the two blades. The motion imparting means is adjustably moveable with respect to the frame of the machine whereby the two blades can be adjusted to converge in a cutting relationship at any point either closely adjacent the needle hole or spaced therefrom. By the provision of the two blades converging at a cutting point at the needle hole, a solution is yielded to the problem of providing an acceptable short tail length on the garment produced. There is also provided by the present invention a bobbin thread pull-off device which assures the stitch forming operation of the sewing machine on the next succeeding seam. The pull-off device includes an oscillatory thread puller blade having a first end which is provided with a thread catching hook and a second end which is secured to one end of a driving arm which in turn is connected to an actuation means. The thread puller blade is positioned between the previously mentioned thread cutter and the top of the bobbin case. The thread pull-of is mounted for movement between a retracted position, remote from the stitch forming area, and an extended position wherein the thread catching hook engages and carries a portion of the bobbin thread back away from the bobbin case upon return of the pull-off to it's initial position. In it's operation, the bobbin thread pull-off will draw bobbin thread from the bobbin just prior to severence of the threads by the thread cutting mechanism. Another element of the thread trimming mechanism is a bobbin thread eyelet which is secured to the bobbin case of the machine for accurately positioning the bobbin thread so as to ensure entrapment of same by the pull-off device.

Broadly stated, it is an object of this invention to provide a thread trimming mechanism adapted to produce a short tail length on the garment sewn.

Another object of this invention is to provide that means which cut both the bobbin thread and needle thread closely adjacent the needle hole while providing a sufficient length of bobbin thread after trimming so that stitching on a succeeding seam may proceed.

Another object of this invention is to provide the means which have the capability of adjusting the first blade relative the second blade.

Another object of this invention is to provide means which have the capability of adjusting that point at which the two blades come into a severing relationship with the sewing theads relative to the needle hole.

Another object of this invention is to provide a means which utilizes two blade cooperable in a true scissor like action to effectively cut all threads, including synthetic threads.

Yet another object of this invention is to provide means which have the capability of correctly positioning the bobbin thread.

Still another object of this invention is to provide a thread trimming mechanism which utilizes a bobbin thread pull-off device.

The above brief description, as well as further objects, features and advantages of the present invention will be more fully appreciated by reference to the following detailed description of a presently preferred, but none the less illustrated embodiment in accordance with the present invention, when taken in conjunction with the several views illustrated in the accompanying drawings, wherein:

FIG. 1 is a plan top view showing the thread trimming mechanism in its retracted position;

FIG. 2 is a sectional view taken along line 2—2 of FIG. 1;

FIG. 3 is an enlarged top elevational view of the knife carrier;

FIG. 4 is a front elevational view showing the thread trimming mechanism;

DESCRIPTION OF THE PREFERRED EMBODIMENT

Figure 5:
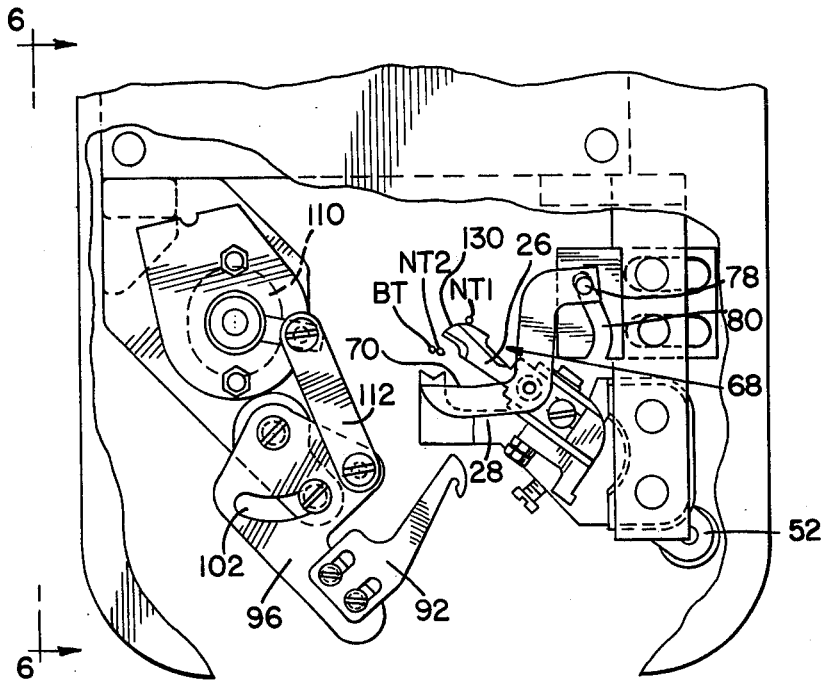
FIG. 5 is a top plan view similar to FIG. 1 depicting the thread cutter immediately after same has been swung inwardly and showing the bobbin thread pull-out remaining in its retracted position.

In the practical development of the invention as shown in FIGS. 1 through 4 a known in the art rotary hook assembly means 10 is secured to the lower rotary main shaft which is longitudinally journalled in the bed 11 of the machine. Operation of such a rotary hook, associated mechanisms and controls for operating same is described in the U.S. Pat. of W. P. Herzer et al, No. 3,982,491, issued Sept. 28, 1976. Journalled within the rotary hook assembly means 10 is a bobbin carrying case means 12 which is prevented from rotating by a restraining finger support means 14. The restraining finger support means 14 is fixedly secured to a thread cutter support means 16 which is secured in any conventional manner to the bed 11. It should be noted that all of the previously described items are positioned beneath the throat plate means 18 which is also secured to the bed 11. The throat plate means 18 is provided with a needle aperture means 20 allowing for passage of the needle means 22 therethrough. The rotary hook means 10 partakes of two revolutions in cooperation with each vertical reciprocation of the needle means 22 whereby concatenating threads into lock stitches.

According to the present invention the thread cutting assembly means 24 is located on the right side of the sewing machine bed 11 as is viewed in FIG. 4.

The thread cutting assembly means 24 includes a first moveable blade means 26 and a second moveable blade means 28. The first blade means 26 has a first end portion means 30; a second end portion means 32 and a medial portion means 34. It should be noted that the first end means 30 of the first blade means 28 is formed as a knife means. The second end means 32 has provided therein a slot means 36, the reason for which will be discussed hereinafter. The second end means 32 of the first blade means 26 is fastened to and carried by a generally L-shaped knife carrier means 38 (FIG. 3). The knife carrier means 38 has provided at its first end means 40 a projection 42 which abuts in the starting position against an upstanding portion means 14 of the finger restraining means 14 thereby limiting the rotational movement of said carrier. The carrier means 38 has a depending rotatable rock shaft that serves as a first pivot portion means 45 for the first blade means 26. The rock shaft means 44 is journalled within a bearing means 46 which is carried by the finger restraining support means 14 and fixedly secured therein by any suitable means such as 48. The rock shaft 44 is connected at its lower end means 50 to an actuating lever means 52 which is forcibly driven by an actuation means (not shown) for swingably actuating the thread cutter assembly means 24.

In the preferred embodiment, the second movable blade means 28 is positioned adjacent and on top of the first blade means 26. The second blade means 28 includes a first portion means 56, a second portion means 58 and a medial portion means 60. The medial portion 60 of the second moveable blade means 28 is pivotally secured to the medial portion means 34 of the first blade means 26 at a point defining a second pivot portion means 47.

The upper blade means 28 and the lower means 26 are pivotally connected from the underside thereof. This is made possible by providing the second end means 39 of the knife carrier means 38 with an aperture means 64 which allows passage of a pivot screw means 62 to secure the moveable blade means together from the underside thereof. A collar means 66, which is slightly thicker than the first blade means 26 surrounds the threaded portion of the pivot screw means 62 which extends through the first blade means 28. By this construction the two moveable blade means 26 and 28 are pivotally secured together at their medial portions 60 and 34 respectively but the first blade means 26 may be slideably adjusted relative to the second blade means 28.

By connecting the medial portions 60 and 34 a force transfer junction means is formed. The force transfer junction means includes the lever means 52 secured to shaft means 44; carrier means 38 connected to shaft means 44 for driving the first and second blade means 26 and 28 respectively. Thus upon actuation of the lever means 52 it is possible to transfer force from the actuation means through the shaft 44 whereby pivoting the first blade means and forcibly driving the second blade means through the pivoting connection 62. In this manner it will be noted that the first blade means 26 has a fixed pivot point about the first pivot portion means 45 while the upper blade means 28 has an eccentric pivoting point about the second pivot point means 47.

The second blade means 28 has provided at its first end means 56 a blade portion means 70 which is located closely adjacent and cooperates with the blade portion means 30 of the lower knife means 26. Arrangement of these two knife means is such that when the depending shaft means 44 is rotatably actuated the first blade means is pivoted or moved upwardly as viewed in FIG. 1 to a position as shown in FIG. 5, and as noted earlier the force transfer junction means including the first blade means 26 forcibly drives the second blade means 28, through the eccentric pivot 62, whereby moving the thread cutter assembly means 24 either forwardly or backwardly thus closing or opening the relative positioning of the knife edges 30 and 70.

As may be best viewed in FIGS. 1 and 2, the true scissor-like action of the two moveable blades is regulated by the cooperation of the second blade means second end means 58 with the motion imparting means 72. The motion imparting means 72 includes a cam block means 74 which is adjustably secured to the thread cutter support means 16 by any suitable means such as 76. The second blade means 28 has provided at its second end means 68 a depending pin means 78 which associates with a partially curved slot means 80 formed in the cam block means 74 thereby forming a floating pivot point in addition to the eccentric pivot point for the second blade means 28. The motion imparting means 72 controls the movement of the second blade means such that the blade portion means 70 inherits three motions relative the needle aperture means 20 upon actuation thereof. These three motions are (1) Upon actuation of the thread cutter assembly the force transfer junction means drives the second blade means 28 through the first blade means 26 such that the blade portion means 70 moves toward the needle aperture means 20; (2) The continued advancement of the actuation means coupled with the kinematics of the system, that is the motion imparted to the first blade means by the fixed pivot point means 45 and the motion imparted to the second blade means by the second eccentric pivot point means 47 coupled with the design of the cam slot means causes the blade portion means 70 to halt it's forward motion; (3) The further advancement of the actuation means causes the blade portion means 70 to back away from the needle aperture means 20. It should be pointed out that these motions are constant and no time lapse inbetween occurs. These motions imparted to the blade means are solely due to the pivot points 45 and 47 and the design of the motion imparting means. It should also be appreciated that is possible to use an entirely curved slot wherein different motions will be imparted upon the second blade means.

In a review of FIGS. 1 and 2 it may be seen that the motion imparting means 72 has an adjustability feature. As mentioned earlier the cam block means 74 is adjustably secured to the thread cutter support means 16. An elongated slot means 84 is provided in the right side section means 86 of the cam block so that an infinite number of settings may be obtained simply by loosening the securing means 76 and positioning the cam block in any desired position. The purpose of providing an adjustability feature is to adjust the floating pivot point at the rear of the second blade means. As shown in FIG. 1, if the cam block means 74 were moved to the left the blade portion 70 of the second blade means 28 would not have as much pivotal motion as is possible when the cam block is secured in the position shown. Because of the decrease in pivotal motion the blades means 30 and 70 converge at a point further away from the needle aperture, this results in a longer thread tail being produced. Due to this adjustability factor it is possible to adjust the length of thread tail remaining or depending from the garment.

As mentioned above the thread trimming mechanism provided by the present invention further includes a thread catching mechanism assembly means 90. As viewed in FIGS. 1 and 4 the thread catching mechanism assembly means 90 is secured in any conventional manner to the left side of the bed 11. The thread catching mechanism assembly means 90 includes an oscillatory thread puller finger means 92 having a thread catching hook means 94 on one end thereof. The thread puller finger means 92 is secured at the end opposite its thread catching hook 94 to a driving arm means 96 which is rotatably supported on a bobbin thread pull-off support means 98. The support means 98 has at it's first end means 97 a depending arm means 99 that is affixed to the bed frame 11 by any suitable means such as 100. The arm means 96 has a curved alignment slot 102 which is retained in suitable alignment by an alignment screw means 104 carried on a boss means 106 formed at the second end means 108 of support means 98. The support means 98 is so positioned and adjusted so that the path of motion of the thread puller arm means 92 is just below the previously mentioned thread cutter assembly means 24 but yet above the top of the bottom case means 12. An actuation means 110 is employed for forcibly oscillating the thread puller arm means 92 into engagement with the bobbin thread. The actuation means 110 is carried by, and depends from, the support means 98. As a result of this design, the entire thread pulling unit may be removed from this machine by undoing the fasteners 100. The arm means 92 is forcibly driven through an actuation assembly means. The actuation means includes a lever means 112 which has its first end means 114 pivotally secured to the arm means 96 and carried by a crank member 118 which is affixed to the driving end of the actuation assembly means 110.

Figure 8:
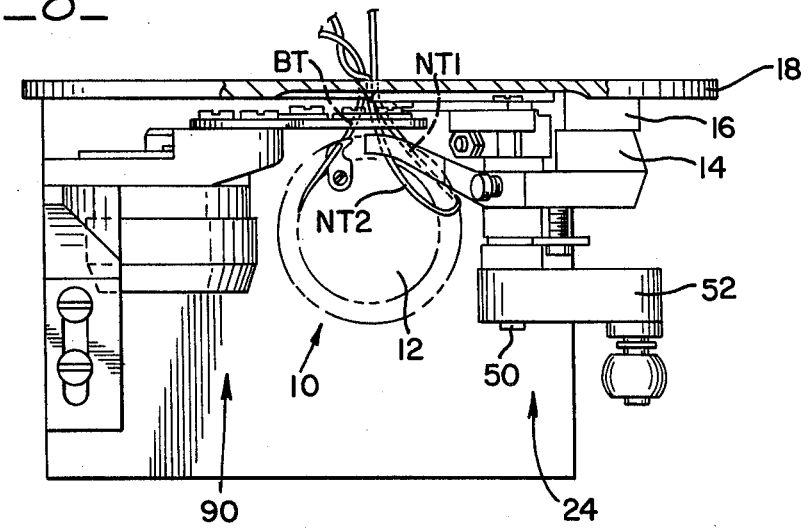
FIG. 8 is a front elevational view of FIG. 7.

As may be viewed in FIGS. 4 and 8, an added feature of the present invention is the provision of a bobbin case eyelet means 120. The bobbin case eyelet means 120 is secured to the bobbin case 12 so that it is positioned approximately half way between the thread release point of the bobbin case and the needle aperture means 20. By so positioning the eyelet means 120, it is possible to effectively guide the bobbin thread "BT" up to the aperture means 20 so that the bobbin thread pull-off arm means 92 can effectively and assuredly seize only the bobbin thread upon actuation of the pull-off assembly means 90.

OPERATION OF THE MACHINE

Figure 9:
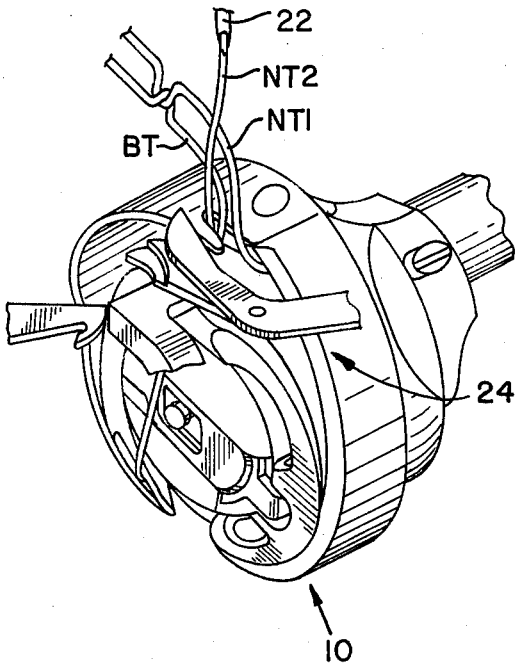
FIG. 9 is a perspective view illustrating the cut-off device and pull-of device in their retracted positions.
Figure 10:
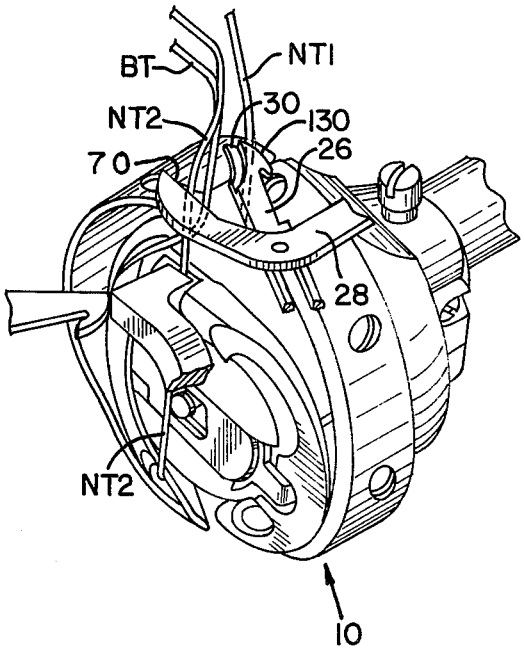
FIG. 10 is a view like FIG. 9 but with the thread catcher in it's advanced position while the bobbin thread pull-off remains in it's retracted position.

In FIGS. 1 and 9 both the bobbin thread pull-off assembly means 90 and the thread cutter assembly means 24 are shown in their retracted or initial position. At this time the needle means 22 is moving upward through the last half of the last stitching cycle. Just prior to the actuation of the thread cutter assembly means 24 the position of the bobbin thread BT and the two legs of the needle thread NT1 and NT2 correspond approximately to the positions shown in FIGS. 1, 4, and 9. As shown in FIGS. 4 and 9 the position of the needle thread loop which is now looped around the hook assembly means 10 is approximately at the 6 o'clock position when the actuating lever means 52 is is forcibly driven to the position as shown in FIG. 5. Keep in mind that the lever means 52 is forcibly driven by an actuating means which in the presently preferred embodiment is in the form of an air cylinder means but it should be apparent to one skilled in the art to substitute an electrically operated solenoid. Therefore, as shown in FIGS. 5 and 10 the trimming assembly mechanism 24 is forcibly moved into the position there shown wherein the first blade means 26 is forcibly swingably moved into a rearward position via the transfer force assembly means. In moving from a position as shown in FIG. 1 to a position as shown in FIGS. 5 and 10, the bobbin thread BT and one leg NT2 of the needle thread loop positions itself generally in the area as shown in FIGS. 5 and 10. As mentioned earlier, the pivotal motion of the first blade means 26, and more particularly the driving action imparted by the medial portion means 34 of the first blade means 28 upon the medial portion means 60 of the second blade means 28 whereby forcibly drives the second blade means 26 through the eccentric pivotal connection means 47 thus causing the second end means 58 of the second blade means 28 to follow the predetermined path of motion imparted to it by the motion imparting means 72. The pin and slot arrangement in the preferred embodiment controls the movement of the blade portion means 70 relative the needle hole means 20 such that the blade portion means 70 approaches the needle aperture and then backs away therefrom as was described earlier. The purpose for imparting such motion to the second blade means is that it lends the desired true scissor-like action to the thread cutter assembly as will hereinafter be discussed.

Figure 7:
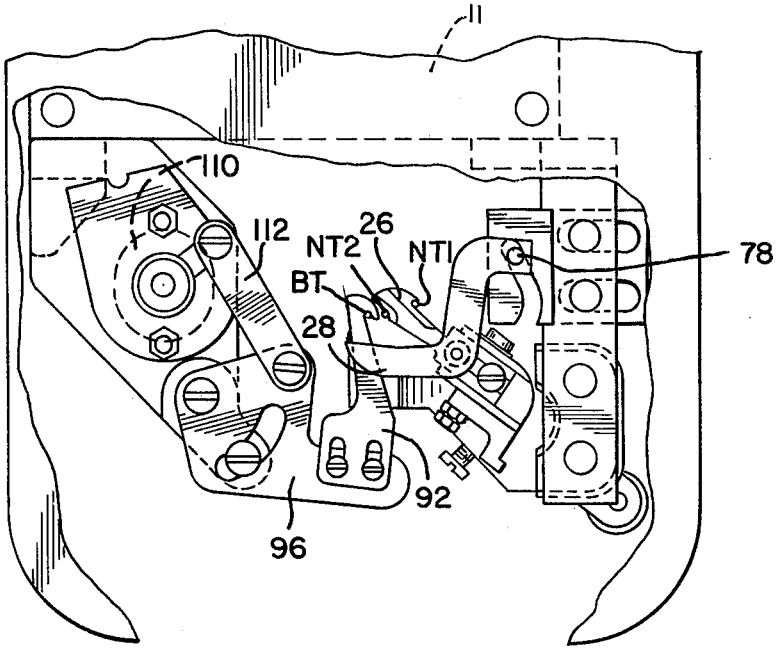
FIG. 7 is a top plan view similar to FIG. 5 depicting the bobbin thread pull-off being rotated into its forward position prior to severance of the threads.
Figure 11:
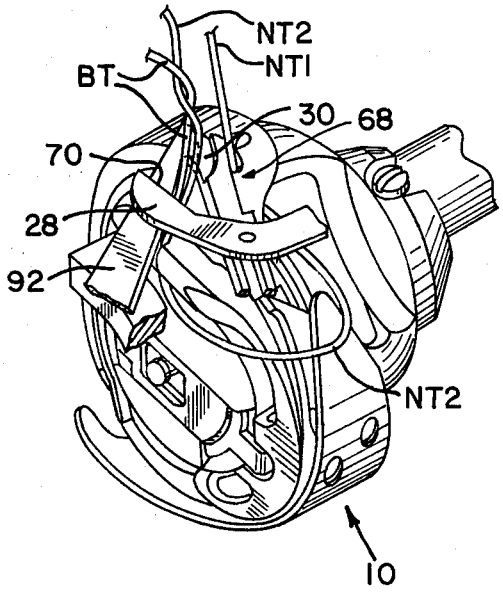
FIG. 11 illustrates both the thread cutter and the bobbin thread pull-off in their swingably advanced position.

Both the blade means 26 and the blade means 28 move towards the rear as viewed in FIGS. 5 and 10 but it should be noted due to the kinematics of the system that the blade means 26 moves at a faster circumferential rate than does the blade means 28. That is, the depending pin means 78 riding in the groove means 80, and in conjunction with the preferred design of the slot means 80, imparts not only the desired motion to the second blade means 28 but also imparts a slower circumferential speed relative the first blade means 26 thereby forming the gap therebetween. It should be noted that during this time period, that is, actuation of the thread trimming mechanism 24, the needle thread loop has advanced about the hook means 10 to assume a position somewhere between the 5 o'clock and 3 o'clock position. During the advanced motion of the needle loop around the hook assembly means 10, the second leg NT1 of the needle thread loop has now moved into the position shown in FIGS. 7 and 11. In this position the second leg NT1 of the needle thread loop is entrapped by that portion generally indicated on the second blade means at 68 such that the two legs NT2 and NT1 are in a separated state. In looking at FIGS. 7, 8, and 11 it may be noted that the position of the needle thread loop now is approximately at the 2 o'clock position when bobbin thread pull-off assembly means 90 is actuated and thus moves into the thread catching position. Once the thread cutter assembly means 24 has attained its open position as shown in FIG. 7 the thread pull-off arm 92 is actuated through energization of the actuation means 110 whereby forcibly driving the lever means 112 toward the bed 11 whereby oscillating arm means 92 into the seizing position.

Figure 12:
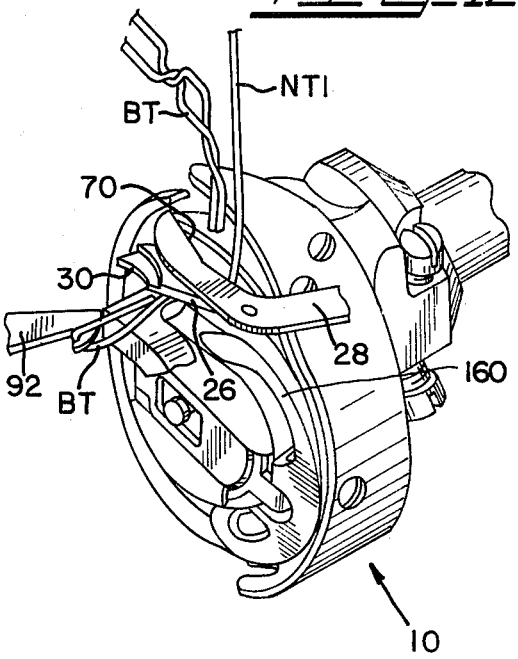
FIG. 12 is a view like FIG. 9 but with both the thread cutter and bobbin thread pull-off returned to their initial starting positions after severance of the threads.

During it's rearward path of motion the hooked end means 94 goes beyond the bobbin thread BT a sufficient distance whereby upon it's return the hook 94 seizes or catches the bobbin thread BT. The reason for which the bobbin thread pull-off does not catch the leg NT2 of the needle loop is that the needle loop is advanced around the hook to its 2 o'clock position and thus that portion, namely NT2, of the needle loop which could possible be seized by the arm means 92 if it were not correctly positioned, is removed from the path of motion of the bobbin thread pull-off arm means 92. It is also important to note that the bobbin thread eyelet means 120 plays an important role in correctly positioning the bobbin thread relative the needle hole means 20. As stated above, upon it's return movement the hooked end of means 94 the bobbin thread pull-off seizes the bobbin thread and effectively draws thread from the bobbin means 12, as shown in FIG. 12, whereby assuring a sufficient length of bobbin thread prior to the succeeding series of stitches. In this regard it is necessary to control the position of the bobbin thread relative to the needle hole and for this reason the bobbin thread eyelet 120 has been provided. It should be noted that the effective amount of time elapsed during energization of the bobbin thread pull-off may be measured in milliseconds. After the bobbin thread pull-off means has returned thus drawing thread from the bobbin prior to severence of the threads, the actuation means associated with driving the lever means 52 returns to its initial position. When the drive lever means 52 is forcibly returned to it's initial position, the force transfer assembly causes the blade means 26 and thus the blade means 28 driven thereby to swing back into the closed position shown in FIG. 12 whereby severing the threads entrapped therebetween.

As was discussed earlier the motion imparting means imparts to the blade portion means a successive series of movements. Upon actuation of the lever means 52 the blade portion means approaches the needle hole. Further movement of the drive lever means 52 causes the blade to come within close proximity with the needle aperture means but this approach does not have the circumferential velocity as the blade first due to the sliding relationship of the pin 80 in the slot. Continued movement of the drive lever means coupled with the motions imparted by the motion imparting means causes the second blade means to actually back away from the needle aperature. It should be noted that the movement of the first blade means is such that it is so actuated as to move in a pivotal motion beyond the needle aperature but does not contain the various motions as are inherent with the second blade means. Once the actuation means for returning the thread cutter is actuated its initial position whereas the motion imparting means causes the second blade means to move toward the returning first blade means (which is the inverse of the above identified movement) thus causing a true scissor-like affect upon the threads entrapped therebetween. The scissor-like action upon the threads yielding a more positive cutting action.

In a review of the operation of the thread catching and trimming mechanism of this invention, three steps are required to be performed. Prior to the end of the sewing operation, and approximately when the needle thread loop is in the 5 o'clock position during the last half of the last stitching cycle the thread trimming mechanism is shifted into its open position as by actuation of the driving lever means 52. Thereafter, as the needle thread loop approaches the 2 o'clock position on the hook means the bobbin thread pull-off assembly means 90 and more particularly the thread catching finger means 92 will be moved from its retracted position shown in FIG. 1 to its advanced position shown in FIG. 7. Upon the return movement of the bobbin thread pull-off the finger means 92 will draw extra bobbin thread from the bobbin case prior to severance of the same by the thread trimming mechanism 24. Keep in mind that the needle loop has been rotated that it is situated so as to be out of the way when the bobbin thread pull-off is actuated. As a final step, the knife mechanism means is returned due to energization of the actuation means associated therewith whereby retracting the driving lever means 52 to its initial position thus causing severance of the thread entrapped therebetween in a true scissor-like manner. The scissor-like action upon the thread yeilding a more positive cutting action. As was mentioned earlier the problem associated with thread trimmers producing a short tail length on the garment produced is the need for a sufficient length of bobbin thread for initial beginning of the next series of stitches. As is apparent there has been provided by the present invention a bobbin thread pull-off which assures an adequate amount of bobbin thread to be present for the next series of stitches. The bobbin case eyelet means 120 assures correct positioning of the bobbin thread whereby enabling the bobbin thread pull-off arm means 70 to entrap and seize only the bobbin thread and retract the same as shown in FIG. 12 prior to the same being severed. By positioning the bobbin thread pull-off beneath the thread trimming assembly there is a portion of the bobbin thread which remains between the blade portions 30 and 70 whereby severance of the same is possible. However, in prior art devices having one moveable blade, it is necessary for the one moveable blade to draw a significant amount of both needle thread and bobbin thread over to the stationary blade where it is severed. This extra drawn thread results in a longer thread tail. By the provision of the two moveable blades cooperating in unison it is possible that the point of severing engagement of the two blades upon the threads may be located at the needle aperture means 20. As mentioned earlier, the motion imparting means 72 controls the movement and speed of the second blade means whereby the knife portion of the two moveable blades can converge at the needle hole and therefore alleviate the extra drawn thread of the prior art devices. It should be noted that with the present embodiment, it is possible, if desired, to adjust the cam block means 74 as was described earlier whereby the blades may converge in cutting unison at a point remote from the needle aperature means whereby producing a tail length of any desired length. The bobbin thread pull-off located beneath the thread trimmer mechanism draws thread prior to severance of the needle and bobbin threads whereby alleviating the extra drawn thread during the cutting operation thus providing a short tail length.

As mentioned earlier, the first blade means 26 has at its second end means 32 a slot means 36. Screw means 29, which are threadably received in threaded aperature means 31 (FIG. 3), associates with the slot means 38 and serves to secure the first blade means 26 to the swing arm means 38. By this design it is possible to move the first blade means 26 relative to the second blade means 28. This adjustment may be necessary when an operator decides to change the thread and it may happen that both legs of thread may not be entrapped as they were with the previous sewing operation. This may be due to the new way the new thread may form the loop. Hence, it is necessary to adjust the first blade means so that the knife edge 30 will be adjusted relative knife edge 70 so as to ensure that both threads may be cut. Yet another problem arises if the needle hole in the throat plate is changed from a round hole to an eliptically shaped hole. Due to the change in shape of the hole the thread will again follow a different path, thus necessitating a change in the first and second blade cutting relationship. By the provisions of this adjustable design these factors are taken into account and thereby it is made easy to adjust the blades to ensure severance of both the needle thread and bobbin thread.

Turning now to FIGS. 1, 3, and 4, it may be seen that a spring wire means 150 is attached to the knife carrier means 38. The spring wire means 150 is securely held in place by a securing means 152 which passes through the body means 154 of the knife carrier means and are threadably engaged on its opposite end with two securing means 156 and 158. In this manner the spring wire means 150 is much easier to adjust in a left to right relationship and in some instances much easier to replace than is shown in prior art devices. The purpose of the spring wire means 150 is to engage resiliently with the carrier 160 (FIG. 12) of the bobbin case whenever the thread trimming mechanism has swung into the position shown in FIG. 5. It is to be understood that when the thread trimming mechanism assembly means 24 is swung into position for cutting off the theads, the spring wire means 150 will engage against the carrier 160 of the bobbin case, and the needle thread, which has been drawn out from the needle means 22 by the seizing beak of the hook means 10 into a loop running around the bobbin case, will be engaged by the spring wire means 150 after the loop is released by the gripper point on the hook means 10. As a result of this engaging action any looping of the needle thread around the gripper tail of the hook means 10 will be prevented. The spring wire means 150 will hold the carrier until it is drawn off through the taking off of the needle thread.

Figure 6:
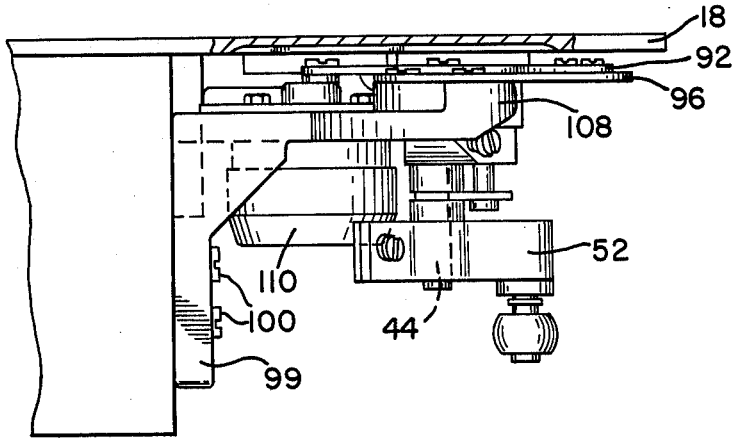
FIG. 6 is a left side elevational view taken along line 6—6 of FIG. 5.

As may be best seen in FIGS. 4, 6, and 8 there is also provided in the preferred embodiment a recess means 162. The top portion 164 of the second blade means 28 is positioned within the recess means 162 enabling a closer relationship with the workpiece (not shown) that is sewn. By providing closer access of the cutting knives to the workpiece, along with the other means provided by the present invention, a shorter tail length will be produced on the sewn garment.

From the aforementioned description it should be clear that the advantages of such a thread trimming mechanism are numerous. By the present invention there is provided a thread trimming mechanism which severs both the bobbin thread and the needle thread at the needle hole thus providing a solution to the technical problem of producing a short tail length. The advantages offered by the unique bobbin thread pull-off mechanism which assures a sufficient length of bobbin thread to be available so as to insure an accurate starting of the next series of stitches which is to be sewn should be noted. Due to the true scissor-like action of the blades upon the threads entrapped therbetween, the need for a thread clamp is eliminated. The provision of the recesss in the throat plate allows for the blades to attain a closer relationship with the workpiece that is sewn thereby adding to the solution of the technical problem of how to produce a short tail length on a garment. The adjustable design feature of the present invention, that is the adjustability of the point at which the blades converge in a cutting relationship should be noted. The added adjustable design feature of the first blade relative to the second blade assures easy adjustment of the blades whereby assuring severance of the threads.

Thus it is apparent that there has been provided, in accordance with the present invention, a thread trimming mechanism for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An automatic sewing machine having a vertically reciprocating needle, a throat plate means, a rotary hook assembly means, a bobbin case journalled in said hook assembly means, finger means below the top of said bobbin case for restraining said case against rotation, and a thread trimming assembly means comprising:

a bobbin thread pull-off assembly means operative between the top of said bobbin case and said throat plate for removing a selected amount of thread from said bobbin case;

a thread cutter assembly means operative between said bobbin thread pull-off means and said throat plate means, said thread cutter assembly means including two moveable blades, means for interconnecting said blades for cooperative movement in unison whereby severing in a true scissor like manner both the bobbin and needle threads below said throat plate means; and mounting means for pivotally mounting one of said blades and reciprocably mounting the other of said blades including means for adjusting the degree of movement imparted to one of said blades.

2. A device for trimming the sewing threads of an automatic sewing machine having, a frame, a thread carrying needle, a hook assembly means including a thread carrying bobbin, a throat plate means having needle aperture means therein, said thread trimming device comprising:

a thead catching means including a moveable arm means formed with a hook for engaging and removing thread from said bobbin, and mounting means for securing said thread catching means to said frame for movement parallel to said throat plate means including means for vertically adjusting the path of said arm means;

a thread cutter shiftably supported on said sewing machine for movement into the needle and bobbin thread path, for remaining in said path to catch the needle thread loop upon its release from said hook assembly means, and for moving out of said needle thread path;

a first actuating means carried on said mounting means for driving said thread catching element into said engaging and removing relationship with said bobbin thread prior to severance of said bobbin and needle threads by said thread cutter means;

a second actuating means independent from said first actuation means for swingably actuating said thread cutter; and adjustable motion imparting means for moving said thread cutter into and out of a predetermined position and capable of varying the severance point of said threads while controlling the movement of said thread cutter in a true scissor like manner.

3. A thread trimming assembly means device of claim 2 wherein:

said thread catching element is pivotaly moveable between a first position remote from said hook assembly means and a second position wherein said thread catching element is in close proximity to said hook assembly means and in the path of said bobbin thread.

4. A thread trimming assembly means of claim 3 wherein the moveable arm means of said thread catching means is moveable between an initial position remote from said hook assembly means and a second engaging position proximate said hook assembly means in the path of said bobbin thread, said arm means movement being in timed relationship relative said thread cutter assembly actuation means whereby movement of said arm means follows entrapment of said needle and bobbin thread by said thread cutter whereby upon return movement of said moveable arm means to said initial position a portion of said bobbin thread is carried away from said looptaker while leaving a portion of said thread in position for severance by said thread cutter means.

5. An automatic sewing machine for forming a successive series of stitches in a workpiece, said sewing machine having a frame means, a vertically reciprocating thread carrying needle, a rotary hook assembly means having a thread carrying bobbin journalled therein, said hook assembly means cooperating with said needle to engage and carry needle thread loops thereabout to form a series of lockstitches, a throat plate means positioned between said needle and said hook assembly means, and a thread trimming assembly means comprising:

bobbin thread pull-off assembly means carried on one side of said frame means for removing thread from said bobbin at the completion of said series of stitches;

thread cutter assembly means carried on the other side of said frame means beneath said throat plate means, said thread cutter assembly means including a support means carried on said frame means, a bobbin restraining finger means secured to said support means, a first moveable blade means having first and second end portions and a medial portion therebetween, said second portion means including a first pivot portion means for pivotally mounting said first blade means on said finger restraining means whereby allowing pivotal motion of said first blade means into the needle and bobbin thread path to catch the needle thread loop upon its release from said hook assembly means, and for moving out of said needle thread path, a second moveable blade means having first and second end portions and a medial portion means therebetween, and means for pivotally connecting the medial portions of said first and second moveable blades, whereby the first end portion means of said first and second blade means are adapted to cooperate together for cutting threads therebetween upon relative pivotal motion of said blades; and motion imparting means adjustably carried on said support means, said motion imparting means associates with the second portion means of said second blade means for moving the second blade means first portion means in at least two directions relative the needle aperture means while first blade means moves in one direction, and for adjusting the degree of travel imparted to said second blade means whereby the motion imparted to the first portion means of said second blade means creates a true scissor like action between said pivotally moveably blades upon the return motion of said first moveable blade.

6. The sewing machine of claim 5 further comprising means for shifting said first and second blade means into and out of said needle thread path and means for rotating said thread removal means in timed relation with movement of said first and second blade means for engaging and carrying a length of bobbin thread away from said bobbin case prior to severence by said thread cutter assembly means.

7. The severence means as defined in claim 5 wherein:

said second blade means second end portion means is provided with a pin means; and said motion imparting means includes a cam block means provided with a slot means which associates with said pin means for controlling the movement of said second blade means.

8. The automatic sewing machine as defined in claim 5 wherein:

said throat plate is provided with recess means and said second blade means is positioned adjacent said recess.

9. The thread cutter assembly means as defined in claim 5, wherein:

the velocity of movement of said first moveable blade means is greater than the velocity of movement of said second moveable blade means.

10. The thread cutter assembly means as defined in claim 5 wherein said first blade means includes means for engaging and holding two legs of said needle thread loop in a spaced relationship.

11. The thread cutter assembly means as defined in claim 5 wherein said first blade means is adjustable relative to said second blade means.

12. The thread cutter assembly means as defined in claim 5 wherein the medial portion means of said first blade means is operable to move said second blade means upon actuation of said first blade means.

13. The thread cutter assembly means of claim 5 wherein said motion imparting means causes the first blade means to cooperate with the second balde means in a scissor like action to sever the thread portions at said needle aperture means.

14. A sewing machine for forming a successive series of stitches including a frame, a throat plate secured to said frame and having a needle aperture therein, a vertically reciprocating needle, a rotary hook assembly means having a first rotation followed by a second rotation, and a thread trimming assembly means comprising:

a pivotally mounted first blade means swingable in a curvilinear path from an initial position remote from said needle aperture to a second position closely adjacent one side of said needle aperture means whereby receiving the needle thread loop from said looptaker while in said second position;

a second blade means eccentrically pivoted to said first blade means and moveable in a path eccentric to the curvilinear path of said first blade means;

a thread catcher means rotatable from a first position remote from said bobbin thread path to a second position proximate said bobbin thread path during the last 180° rotation of said hook assembly second rotation for engaging and withdrawing a length of thread from said bobbin prior to severance of said needle thread and bobbin thread;

a bobbin thread eyelet means carried by said bobbin case for positioning said bobbin thread in a path which intersects the path of said thread catcher means; and means for forcibly driving said first and second blade means from said second position to said initial position whereby severing in a true scissor like manner said bobbin thread and said needle thread at an adjustable predetermined point.

15. The thread trimming assembly means of claim 14 further comprising:

an adjustable motion imparting means associating with said second blade means for controlling the point of severence of said first and second blade means relative said needle aperture means.

16. The thread trimming assembly means of claim 14 wherein said first and second blade means are advanced and returned during said hook assembly means second rotation.

17. The thread trimming assembly means of claim 15 wherein said motion imparting means is operatively effective to drive said second blade means at a speed less than that of said first blade means.

18. The thread trimming assembly means of claim 16 wherein the first end means of said bobbin thread pull-off lever means is formed with a hook for engaging and carrying a portion of said bobbin thread away from said bobbin.

19. In a sewing machine having a throat plate means including needle aperture means which allows passage of a reciprocating thread carrying needle therethrough which cooperates in the formation of stitches at a stitching location with a looptaker which is arranged beneath said throat plate and houses a thread carrying bobbin, an improved trimming mechanism positioned beneath said throat plate means adjacent to said stitching location comprising:

a thread severing mechanism means including a first fulcrumed cutting blade means;

a second fulcrumed cutting blade means;

means for interconnecting said blades for cooperative movement in unison;

means for actuating said thread severing means, said actuation means having a driving cycle and a retractable cycle;

an adjustable motion imparting means in operative engagement with one of said fulcrumed blade means adapted to vary the length of thread tail and capable of moving said blade means in at least two directions relative said aperture means during the retractable cycle of said actuation means whereby yielding a true scissorlike action between said blade means when said blade means is retracted; and a bobbin thread pull-off means including a bobbin thread pull-off member means having a hook means at the free extremity thereof, means for pivotally mounting said member means for movement along a curvilinear path from a retracted position into an extended position whereby said hook means engages and withdraws from said bobbin a thread remaining wound thereon in advance of the severance of said needle thread and said bobbin thread by said thread severing means.

20. The thread trimming mechanism of claim 14 wherein said thread catcher means comprises:

a bobbin thread pull-off lever means;

mounting means for securing said thread catcher means to said frame including means for vertically adjusting the path of said lever means;

rotatable drive means driven in timed relationship to the movement of said first blade means;

means operatively connecting said drive means to said bobbin thread pull-off lever means including pivotal mounting means for pivotally oscillating said pull-off lever means between said first and second positions.

* * * * *